United States Patent [19]

Rinaldi

[11] 4,119,052

[45] Oct. 10, 1978

[54] SEMI-SUBMERSIBLE VESSEL

[76] Inventor: Victor Rinaldi, 11, rue du Pré-aux-Clercs, 75007 Paris, France

[21] Appl. No.: 809,973

[22] Filed: Jun. 27, 1977

[30] Foreign Application Priority Data

Jun. 30, 1976 [FR] France ..... 76 19856

[51] Int. Cl.[2] ..... B63B 35/44

[52] U.S. Cl. ..... 114/264; 9/8 P; 114/56

[58] Field of Search ..... 61/92, 101, 69; 114/244, 264–267, 44, 49, 50–55, 257, 256, 56; 115/27 D, 20; 9/8 R, 8 P, 8.3 R, 8.3 E, 9, 311, 310

[56] References Cited

U.S. PATENT DOCUMENTS

| | | | |
|---|---|---|---|
| 1,225,023 | 5/1917 | Foote | 9/311 |
| 3,109,183 | 11/1963 | Overmyer | 114/266 |
| 3,237,885 | 3/1966 | Mohar | 115/20 |
| 3,550,385 | 12/1970 | Lowd | 114/257 |
| 3,693,361 | 9/1972 | Koehler | 114/267 |
| 3,893,403 | 7/1975 | Gay | 114/244 |

*Primary Examiner*—Trygve M. Blix
*Assistant Examiner*—D. W. Keen
*Attorney, Agent, or Firm*—DeLio and Montgomery

[57] ABSTRACT

A semi-submersible vessel comprising at least one hollow toroidal element adapted to float with its plane upright having an exposed upper portion carrying a working platform. The toroidal element preferably is formed by describing a circular or elliptical locus with the center of a circular or elliptical generating figure, the size of the generating figure being larger at the bottom than at the top of the floating toroidal element.

11 Claims, 7 Drawing Figures

FIG. 1
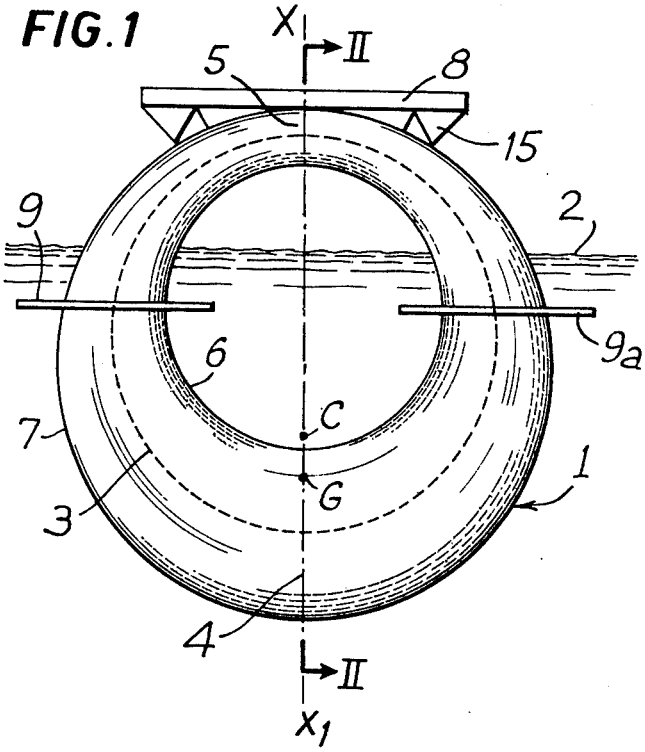
FIG. 2
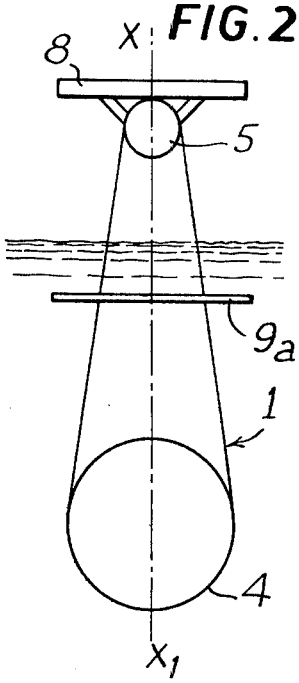
FIG. 3
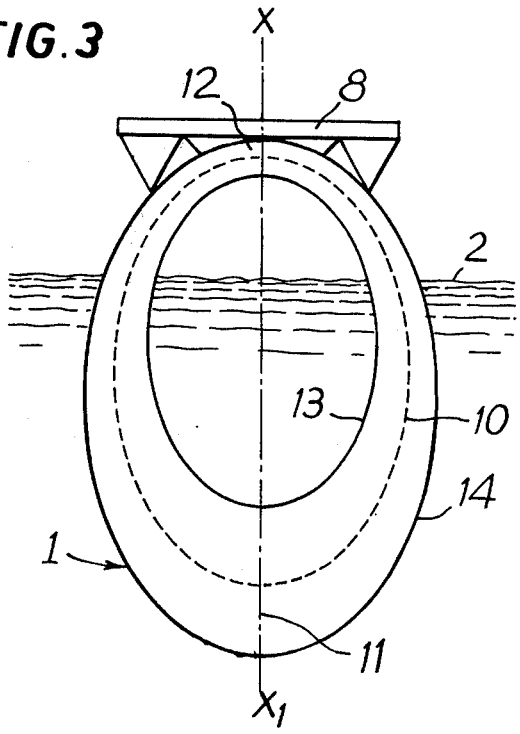
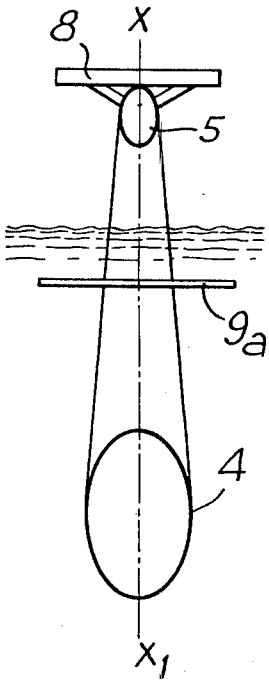
FIG. 2a

SEMI-SUBMERSIBLE VESSEL

The present invention relates to a semisubmersible vessel comprising at its upper part a platform for use in exploiting oceanic waters.

Various types of vessels or platforms are known which are used for exploiting resources at sea. However, these vessels are comprised of different elements so complicated in shape as to require specialist and individual means for their production.

An object of the present invention is to provide a semi-submersible vessel in a very simple and basic structural form.

According to the present invention there is provided a semi-submersible vessel comprising a toroidal element in the form of a closed envelope adapted to float upright and partially immersed with the plane of the toroidal element disposed vertically with respect to the water surface with its centre of gravity situated below the centre of buoyancy, said toroidal element having a horizontal platform mounted to its non-immersed upper part.

The vessel can thus comprise a single onepiece part and be of simple geometry permitting good stability in swell and waves at sea. Moreover, it is of a construction which can easily be made in a building basin of relatively shallow depth. The toroidal element preferably has a smaller cross-section in its top or upper part than at its lower part, the inner and outer peripheries of the toroidal element in the plane of the element thus being eccentric.

This eccentricity of the enclosure gives to the vessel a good stability because not only does it facilitate ballasting, but also it gives a good and adequate depth of immersion to the major part of the buoyancy volume, thus to minimise the disturbing action of swell on the vessel.

The invention will be further described, by way of example, with reference to the accompanying drawings, in which:

FIG. 1 is a view in elevation of one embodiment of vessel according to the invention comprising a toroidal element in the form of a closed envelope;

FIG. 2 is a view in elevation in section taken along the line 2—2 of FIG. 1 where the toroidal element has a circular cross-section;

FIG. 2A is a view in elevation in section taken along the line 2—2 of FIG. 1 where the toroidal element has an elliptical cross-section;

FIG. 3 is a view in elevation of another embodiment of vessel in the form of an elliptical toroidal element of which the major axis is vertical;

Figure 4:
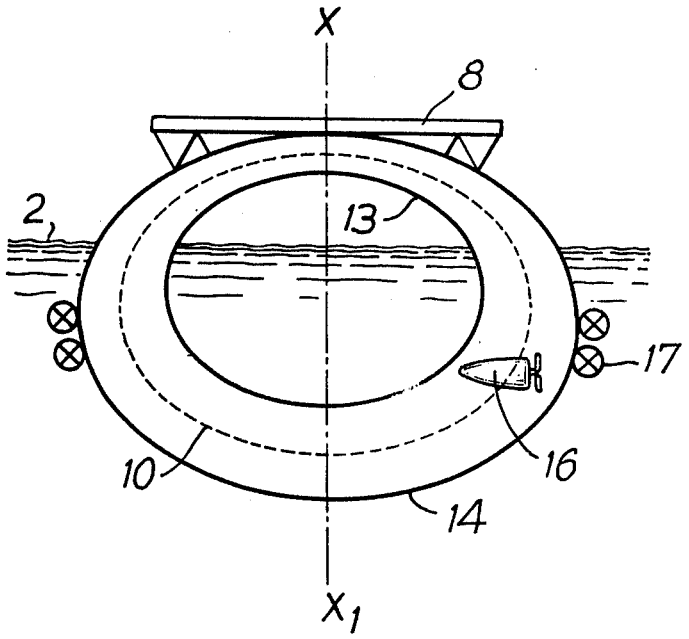
FIG. 4 is a view in elevation of another embodiment of a vessel having an elliptical toroidal element of which the major axis is horizontal.

Referring to FIGS. 1 and 2, there has been represented an embodiment of semi-submersible vessel which comprises a single closed water-tight enclosure 1 of a generally toroidal form, partly immersed with reference to the surface 2 of water and the axis of symmetry $XX_1$ of which is disposed vertically with reference to the said water surface.

The toroidal element 1 is formed by displacing a closed generating figure around a circular locus circle 3 represented in broken lines in FIG. 1. The said generating figure has a variable cross-section which is a maximum at the bottom 4 of the enclosure and a minimum at the top part 5 such that the inner and outer peripheries 6 and 7 of the toroidal element in the plane of the element are eccentric one with respect to the other. FIG. 2 shows the case where the generating figure is a circle although it is equally possible, as represented in FIG. 2*a*, to form the toroidal enclosure element 1 of the vessel from a generating figure in the form of an ellipse of which the centre is displaced following the circle 3 represented in broken lines in FIG. 1, the said generating ellipse being of variable cross-section as explained above.

Following the embodiment represented in FIG. 2*a* the major axis of the generating ellipse extends along the axis of symmetry $XX_1$ of the vessel. It is equally possible to dispose the major axis of the generating ellipse perpendicular to the axis $XX_1$.

The vessel thus floats in upright position by reason of appropriate ballasting which permits the centre of gravity G to be found below the centre of buoyancy C.

The upper part 5 of the enclosure 1 of the vessel is furnished with a horizontal platform 8 fixed thereto by means of beams 15.

From the platform 8 are carried out the various operations, especially of well drilling. About the toroidal element 1 on the immersed part there are provided stabilisation planes 9, 9*a* intersecting the locus 3 at right angles and operative to damp rolling movement of the vessel at sea.

FIG. 3 shows another embodiment of the enclosure 1 which also has a substantially toroidal form, which is formed from a circular generating figure the centre of which is displaced along an elliptical locus 10 represented in broken lines, said generating circle having a variable cross-section which, as before, is at a maximum at the lower part 11 and a minimum at the upper part 12 of the toroidal element such that the elliptical inner and outer peripheries 13 and 14 of the toroidal element in the plane of the element are eccentric one with respect to the other.

FIG. 3 shows the elliptical toroidal element orientated with its major axis vertical, coinciding with axis $XX_1$, but it is equally possible, as represented in FIG. 4, to dispose the elliptical locus 10 with its major axis orientated horizontally and with its minor axis situated along the axis $XX_1$. As in the embodiment of FIG. 2*a* it is possible to replace the generating circle in the case of the FIGS. 3 and 4 by a generating ellipse displaced with its centre following the elliptical locus 10.

Approximation of the different geometrical surfaces for the toroidal element as described above, for the construction of the boundary of the enclosed and water-tight enclosure 1 of the vessel, may be substantially different, according to whether one constructs the enclosure in prestressed concrete or from prefabricated elements, for example in the form of polygonal panels, which may be plane or curved.

The vessel can be provided with propellers 16, installed in nacelles on the sides of the hull (FIG. 4) which, in conjunction with transverse propellers 17, permit the dynamic positioning of the vessel.

Figure 5:
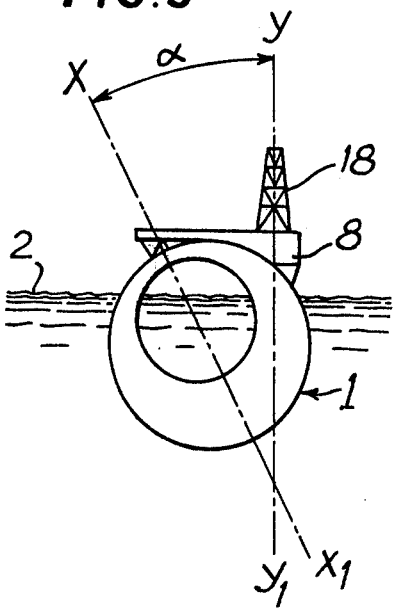
FIG. 5 is a view in elevation of a vessel of which the toroidal element has an axis of symmetry inclined with reference to the vertical.

In the embodiment represented in FIG. 5, the toroidal enclosure element 1 constituting the vessel is disposed with its axis of symmetry inclined at an angle $\alpha$ with reference to the vertical axis $YY_1$. This inclination, obtained by adequate centering of the centre of gravity under the centre of bouyancy, permits easy installation of a derrick 18 on the platform 8.

Because when lying on its side the vessel only has a relatively shallow draught, it can readily be constructed in a basin in shallow water. After being towed to sea it can then be repositioned by the ballast at last to occupy the required upright position as illustrated.

To facilitate this, the lower part 4 includes reservoirs which are utilised for the ballasting and which are employed subsequently for the storage of crude oil under equi-pressure condition with the ambient surroundings.

A communication is established between the platform 8 and the summit 5 of the enclosure the interior of which is compartmentalised by vertical and horizontal partitioning.

Figure 6:
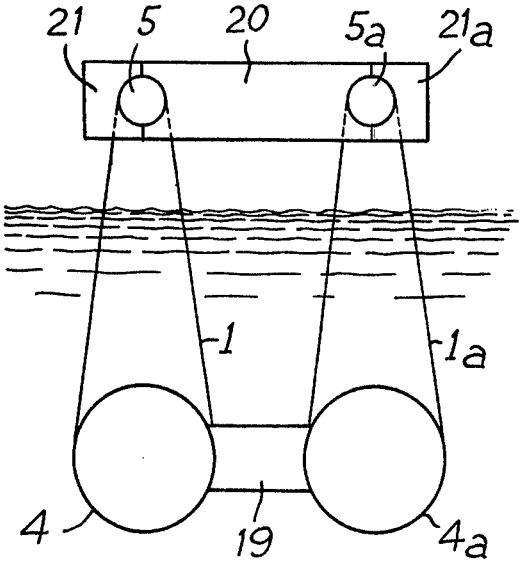
FIG. 6 is a view in elevation of a vessel comprising two toroidal elements.

FIG. 6 shows a modular embodiment of a large platform semi-submersible vessel constituted by two identical enclosures 1, 1*a* of the types represented in FIGS. 1 to 4.

The enclosures 1, 1*a* are connected rigidly one to the other by connecting structure 19 at the level of the lower bulbous portion 4, 4*a*.

At their upper part 5, 5*a* the enclosures 1, 1*a* are joined by a platform in three parts. A central part 20 of the platform is rigidly connected to the two lateral parts 21, 21*a* to enclose the upper arched parts 5, 5*a* of the two toroidal enclosure elements, which elements are then embedded in the interior of the platform.

I claim:

1. A semi-submersible vessel comprising a toroidal element in the form of a closed envelope defined by passing the center of a generating closed figure along a closed loop locus, said locus lying in a vertical plane and said closed figure being of variable size and having a maximum size at the lower part of the toroidal element and a minimum size at the upper part of the toroidal element so that the vessel's center of gravity is situated below its center of buoyancy, said toroidal element having a platform having a horizontal upper surface mounted on its non-immersed upper part.

2. A semi-submersible vessel according to claim 1, wherein the closed generating figure is a circle.

3. A semi-submersible vessel according to claim 1, wherein the closed generating figure is an ellipse.

4. A semi-submersible vessel according to claim 1, wherein the toroidal element is formed by moving the centre of the closed generating figure about a circular locus.

5. A semi-submersible vessel according to claim 1, wherein the toroidal element is formed by moving the centre of the closed generating figure about an elliptical locus.

6. A semi-submersible vessel according to claim 5, wherein the major axis of the elliptical toroidal element is disposed vertically.

7. A semi-submersible vessel according to claim 5, wherein the major axis of the elliptical toroidal element is disposed horizontally.

8. A semi-submersible vessel according to claim 1, comprising stabilisation planes projecting from locations on the immersed part of the toroidal element, the stabilisation planes intersecting at right angles the locus of the centre of the generating figure.

9. A semi-submersible vessel according to claim 1, wherein the toroidal element has an axis of symmetry extending vertically with respect to the water surface.

10. A semi-submersible vessel according to claim 1, wherein the toroidal element has an axis of symmetry that is inclined to the vertical.

11. A semi-submersible vessel according to claim 1 which is comprised of at least two of said toroidal elements, the toroidal elements being connected rigidly by structure at the centre of their base and by a platform at their top in which is embedded the upper part of each of the toroidal elements.

* * * * *